United States Patent [19]

Buchholz

[11] Patent Number: 4,890,862

[45] Date of Patent: Jan. 2, 1990

[54] BUSINESS FORM WITH REMOVABLE, ADHESIVE FREE DATA CARD

[75] Inventor: William T. Buchholz, Crystal Lake, Ill.

[73] Assignee: UARCO Incorporated, Barrington, Ill.

[21] Appl. No.: 240,535

[22] Filed: Sep. 6, 1988

[51] Int. Cl.[4] ..... B42D 15/00; B42F 5/00; B41L 1/20; B65D 27/22

[52] U.S. Cl. ..... 283/62; 283/81; 282/12 A; 229/69

[58] Field of Search ..... 283/62, 81; 282/11.5 A, 282/12 A, 12 R, 25; 281/6, 4; 206/610, 611, 620; 229/69; 40/359; 428/121, 181

[56] References Cited

U.S. PATENT DOCUMENTS

| | | | |
|---|---|---|---|
| 2,304,523 | 12/1942 | Young . | |
| 2,377,348 | 6/1945 | Lee . | |
| 2,758,695 | 8/1956 | Symonds . | |
| 3,191,968 | 6/1965 | Sornberger . | |
| 3,343,851 | 9/1967 | Bensler, Sr. et al. . | |
| 3,383,121 | 5/1968 | Singer | 282/12 R |
| 3,917,276 | 11/1975 | Green Barg . | |
| 4,172,605 | 10/1979 | Welsch et al. | 229/69 |
| 4,346,916 | 8/1982 | Shelton | 282/11.5 A |
| 4,529,227 | 7/1985 | Fields . | |
| 4,549,750 | 10/1985 | Stone et al. | 283/81 |
| 4,551,373 | 11/1985 | Conlon | 283/81 |
| 4,575,121 | 3/1986 | Conti . | |
| 4,627,994 | 12/1986 | Welsch | 282/12 A |
| 4,636,099 | 1/1987 | Goldstone . | |
| 4,705,297 | 11/1987 | Wakeman . | |
| 4,708,503 | 11/1987 | Poor . | |
| 4,776,510 | 10/1988 | Jenkins | 229/69 |

FOREIGN PATENT DOCUMENTS

| | | | |
|---|---|---|---|
| 0129950 | 1/1985 | European Pat. Off. | 282/11.5 A |

*Primary Examiner*—Douglas D. Watts
*Assistant Examiner*—Paul M. Heyrana, Sr.
*Attorney, Agent, or Firm*—Wood, Dalton, Phillips, Mason & Rowe

[57] ABSTRACT

A business form includes a carrier web 10 mounting a card 12 made up of an outer frame 40 and interior, removable, variable information removing section 38. The card 12 is adhered to the web 10 by adhesive 54 only interconnecting the frame 40 and the web 10 with the interior removable section 38 being free from adhesion to the web 10.

7 Claims, 2 Drawing Sheets

BUSINESS FORM WITH REMOVABLE, ADHESIVE FREE DATA CARD

FIELD OF THE INVENTION

This invention relates to business forms, and more particularly, to business forms including a carrier web to which is tipped a removable data card.

BACKGROUND OF THE INVENTION

To facilitate processing through computer printers or the like, the business form industry has provided carrier webs to which individual data cards are adhered by a removable adhesive, frequently a rubber based adhesive. The carrier webs are generally provided with line holes or feed holes along both longitudinal margins to facilitate feeding through a computer printer and as the cards are taken to the printing position of the printer, variable information is inscribed thereon.

Thereafter, the carrier web may be separated into individual form lengths and conveyed to a recipient or, in some instances, the cards may be removed without severing the carrier web into individual form lengths.

This type of form works well for its intended purpose but does have a drawback. In particular, almost invariably, some greater or lesser amount of the adhesive used to adhere the card to the carrier sheet comes off of the carrier sheet and remains adhered to the card. Grime may then adhere to the adhesive on the card making the card look unsightly or, when the card is placed in a billfold or the like, may cause the card to adhere to other cards to the inconvenience of the card holder.

The present invention is directed to overcoming one or more of the above problems.

SUMMARY OF THE INVENTION

It is the principal object of the invention to provide a new and improved business form including a carrier and a removable data card. More specifically, it is an object of the invention to provide such a business form wherein the data card may be removed from the carrier strip and will not carry any adhesive residue.

An exemplary embodiment achieves the foregoing object in a structure including an elongated carrier web having feed openings along at least one longitudinal margin and fold lines extending generally transversely across the carrier web to permit the same to be zigzag folded. A plurality of information receiving sheets or cards are adhered to the carrier web at generally regular intervals along the length thereof and between the fold lines. Each sheet or card has an outer periphery and a peripheral cut within the outer periphery so as to define an outer frame and an interior, removable section within the frame. Each frame is adhered to the carrier web and each removable section is free of adhesion to the carrier web and removably connected to its associated frame by a frangible connection.

As a result of the foregoing, the interior removable section will be carried with the frame on the carrier web to be processed through a computer printer in the usual fashion and then may be removed from the carrier web by breaking of the frangible connection. Because there is no adhesion of the interior removable section to the carrier web at any time, there can be no residual adhesive carried with the card defined thereby once removed from the web.

In a highly preferred embodiment, each frame is broken by a tab connected to the associated interior removable section. Each such tab is free of adhesion to the carrier web. As a consequence, the tab may be lifted and grasped to facilitate removal of the interior removable section.

In a highly preferred embodiment, the tab is joined to the associated interior removable section by a readily severable connection of somewhat greater strength than the frangible connection. Thus, the lifting of the tab with continued force being applied thereto will in turn sever the frangible connection to separate the removable section from the frame.

Preferably, both the outer periphery and the peripheral cut are generally rectangular.

In a highly preferred embodiment, the peripheral cut is defined by alternating slits and ties so that each variable information receiving section or interior section may be removed from the carrier by severing the ties. The ties in turn define the frangible connection referred to earlier.

In a highly preferred embodiment, two additional spaced slits are located in the card or sheet and extend across the frame from at least one of the edges to the peripheral cut. The peripheral cut between the two slits has at least one relatively strong tie to thereby define the removal tab referred to previously.

Other objects and advantages will become apparent from the following specification taken in connection with the accompanying drawings.

DESCRIPTION OF THE PREFERRED EMBODIMENT

Figure 1:
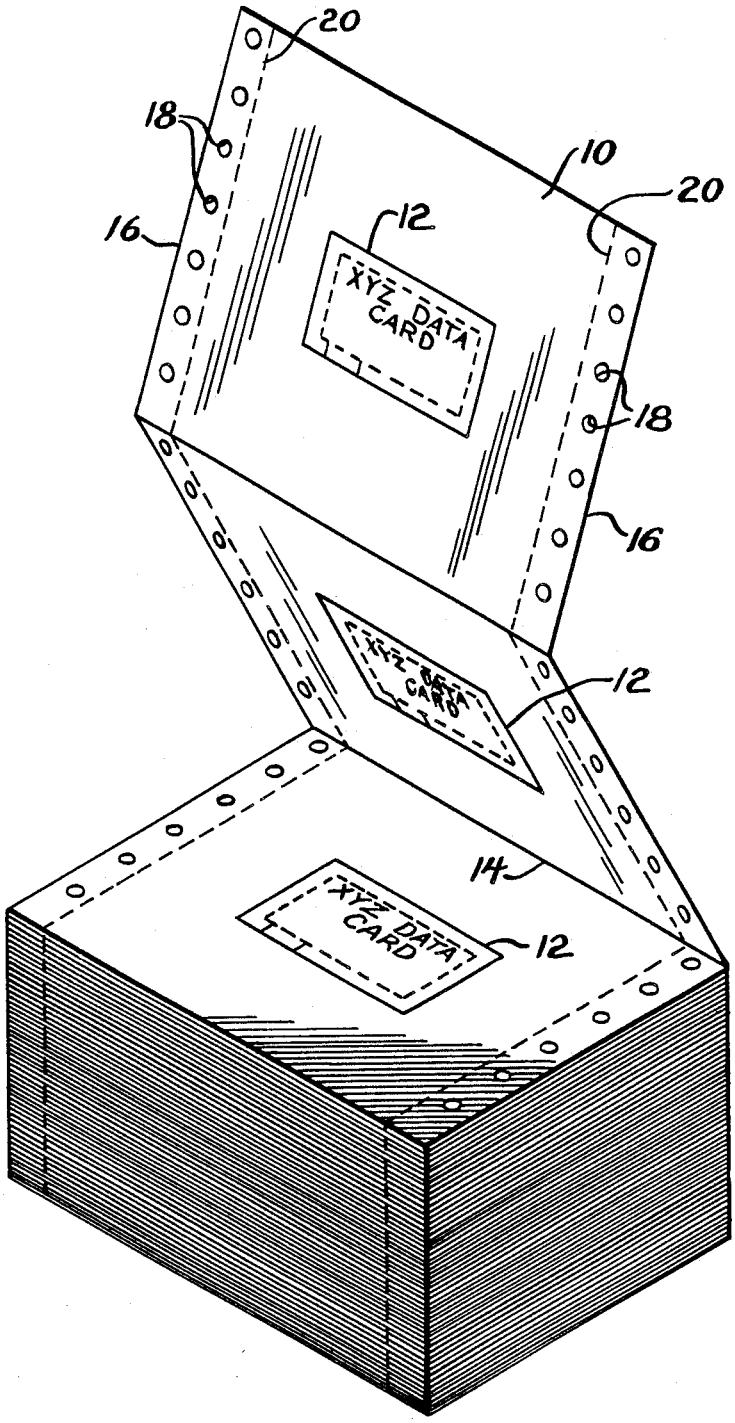
FIG. 1 is a perspective view of a zigzag folded business form made according to the invention.

An exemplary embodiment of a business form made according to the invention is illustrated in the drawings and with reference to FIG. 1 is seen to be made up of two basic components. The first is an elongated carrier web 10. The second is a sheet or card 12 adhered to the carrier web 10 at regular intervals between fold lines 14 that extend transversely across the web 10. In most cases, the fold webs 14 may be perforated so as to allow the web 10 to be severed at regular intervals. In any event, their purpose is to allow the web 10 to be zigzag folded into a stack as illustrated in FIG. 1.

The web 10, on both longitudinal margins 16, is provided with a plurality of line or feed holes 18 which may be used both in the manufacturing of the form as well as in the processing of the same through a computer printer. Optionally, although certainly not necessarily, longitudinal perforation lines 20 may be closely adjacent to the margin 16. The structure of each card 12 is best ascertained by reference to FIGS. 2–6 inclusive. Generally speaking, the card 12 will be of relatively heavy stock but that need not be the case.

In any event, the same is generally rectangular having top, bottom, left and right hand side edges 22, 24, 26 and 28 respectively that are located well within the margins 16 and between adjacent fold lines 14.

Located within the edges 22, 24, 26 28, usually about a quarter of an inch or the like, is a peripheral cut 30. In the illustrated embodiment, the peripheral cut 30 is also rectangular (although it may have slightly rounded corners 32) and is made up of alternating slits 34 and thin, weak ties 36. The ties 36 thus form a frangible connection extending between an interior section 38 of the card 12 and an exterior or outer frame 40 which is defined by the edges 22, 24, 26, 28 and the peripheral cut 30. That is to say, by severing the ties 36, the interior section 38 may be removed.

The face of the interior section 38 is adapted to receive variable information from a computer printer or the like in a conventional fashion.

In the illustrated embodiment, near the lower left hand corner, there are two slits 44 and 46 which are spaced apart by approximately one half of an inch and extend from the bottom edge 24 to the peripheral cut 30. The slits 44 and 46 define a removal tab 48 which may have a legend thereon as is apparent from FIG. 6.

Figure 6:
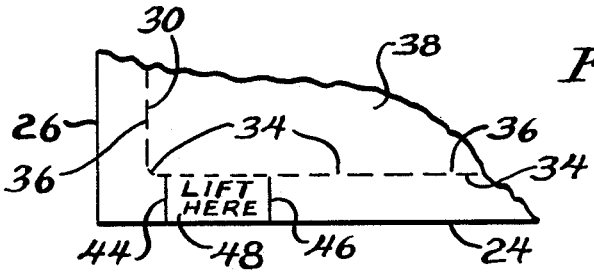
FIG. 6 an enlarged, fragmentary view of a corner of a sheet or card utilized in the invention.

As best seen in FIG. 6, in the area between the slits 44 and 46, the peripheral cut 30 includes several, relatively strong ties 50. The resulting connection of the tab 48 to the interior removable section 38 is stronger than the connection of the latter to the frame 40. As a consequence, by grasping the tab 48 and lifting the same, the ties 36 will be broken so as to allow removal of the interior card 38 from the frame 40. After that is accomplished, the tab 48 may be severed from the card 38 by breaking the ties 50. This sequence of first breaking the ties 36 and then breaking the ties 50 is assured by reason of the relative strengths of the ties, the weaker ties 36 breaking before the stronger ties 50.

Figure 2:
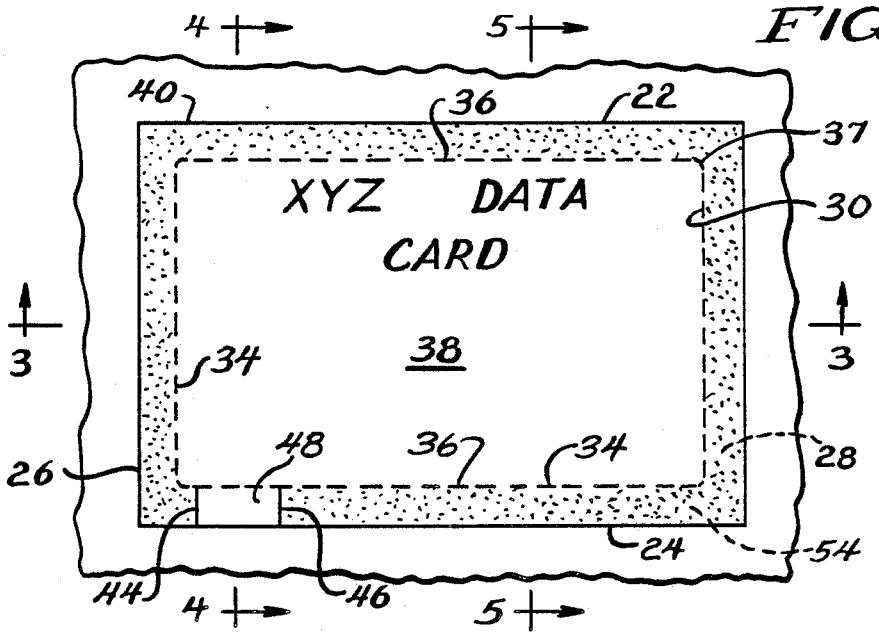
FIG. 2 is an enlarged, fragmentary plan view of a portion of the business form.
Figure 3:
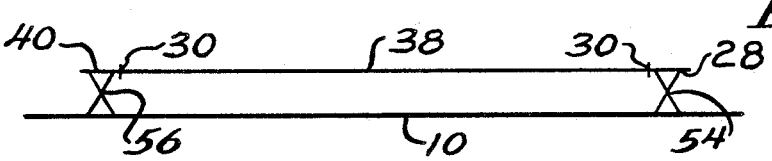
FIG. 3 is a somewhat schematic, sectional view taken approximately along the line 3—3 in FIG. 2.
Figure 4:
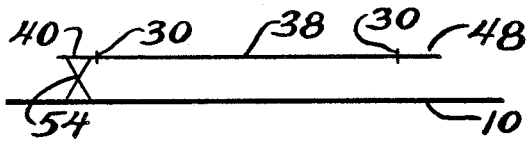
FIG. 4 is a somewhat schematic, sectional view taken approximately along the line 4—4 in FIG. 2.
Figure 5:
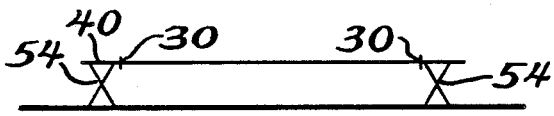
FIG. 5 is a somewhat schematic, sectional view taken approximately along the line 5—5 in FIG. 2.

In order to assure that the card 38 may be removed from the web 10 without any residual adhesive, adhesive is applied only to the frame 40 as indicated by the somewhat wiggly line 54 appearing in FIG. 2. Such adhesive is also indicated by "X's" 54 in FIGS. 3, 4 and 5. It will thus be seen that the area or interface between the web 10 and the card 38 is free from adhesive or any adhesive bond. It will also be seen that no adhesive is placed between the web 10 and the tab 48 so as to allow the same to be easily grasped.

As a consequence of the foregoing construction, the business form may be processed identically to prior art forms of a similar type. However, when the card is removed from the carrier, it will be appreciated that it will be free from any residual adhesive and thus cannot accumulate grime or adhere to other cards in a billfold of the recipient.

What is claimed is:

1. A business form comprising:

an elongated carrier web having feed openings along at least one longitudinal margin and fold lines extending generally transversely across the carrier web to permit the same to be zigzag folded; and a plurality of information receiving sheets or cards adhered to said carrier web at generally regular intervals along the length thereof and between the fold lines, each sheet or card having an outer periphery and a peripheral cut within said outer periphery so as to define an outer frame and an interior removable section within said frame; each said frame being adhered to the carrier web and each said removable section being free of adhesion to said carrier web and removably connected to its associated frame by a frangible connection.

2. The business form of claim 1 wherein each frame is broken by a tab connected to the associated section; each said tab being free of adhesion to said carrier web.

3. The business form of claim 2 wherein each said tab is joined to the associated section by a readily severable connection of somewhat greater strength than said frangible connection.

4. The business form of claim 1 wherein both said outer periphery and said peripheral cut are generally rectangular.

5. A business form comprising:

an elongated carrier web having feed openings along at least one longitudinal margin and fold lines extending generally transversely across the carrier web to permit the same to be zigzag folded; and a plurality of information receiving sheets or cards adhered to said carrier web at generally regular intervals along the length thereof and between the fold lines, each sheet or card having top, bottom and side edges and a peripheral cut within said edges, that part of said card or sheet between said edges and said cut defining a frame, the remainder of said card or sheet defining a variable information receiving section, adhesive securing each said frame to said carrier web, said peripheral cut being defined by alternating slits and ties so that each said variable information receiving section may be removed from said carrier web by severing said ties.

6. A business form comprising:

an elongated carrier web having feed openings along at least one longitudinal margin and fold lines extending generally transversely across the carrier web to permit the same to be zigzag folded; and a plurality of information receiving sheets or cards adhered to said carrier web at generally regular intervals along the length thereof and between the fold lines, each sheet or card having top, bottom and side edges and a peripheral cut within said edges, that part of said card or sheet between said edges and said cut defining a frame, the remainder of said card or sheet defining a variable information receiving section, adhesive securing each said frame to said carrier web, said peripheral cut being defined by alternating slits and ties so that each said variable information receiving section may be removed from said carrier web by severing said ties, and two spaced slits in said card or sheet extending across said frame from at least one of said edges to said peripheral cut, said peripheral cut, between said two slits having at least one relatively strong tie to thereby define a removal tab.

7. The business form of claim 6 wherein that part of said frame between said two slits is free of adhesion to said carrier web.

* * * * *